US011313101B2

(12) United States Patent
Umizaki et al.

(10) Patent No.: US 11,313,101 B2
(45) Date of Patent: Apr. 26, 2022

(54) CONSTRUCTION MACHINE

(71) Applicant: Hitachi Construction Machinery Tierra Co., Ltd., Koka (JP)

(72) Inventors: Yuuki Umizaki, Koka (JP); Makoto Motozu, Moriyama (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 537 days.

(21) Appl. No.: 16/330,454

(22) PCT Filed: Sep. 29, 2017

(86) PCT No.: PCT/JP2017/035569

§ 371 (c)(1),
(2) Date: Mar. 5, 2019

(87) PCT Pub. No.: WO2019/064517

PCT Pub. Date: Apr. 4, 2019

(65) Prior Publication Data

US 2021/0324606 A1 Oct. 21, 2021

(51) Int. Cl.

| | |
|---|---|
| ***E02F 9/08*** | (2006.01) |
| ***E02F 3/32*** | (2006.01) |
| *E02F 9/18* | (2006.01) |

(52) U.S. Cl.

CPC ..... *E02F 9/0891* (2013.01); *E02F 3/325* (2013.01); *E02F 9/0866* (2013.01); *E02F 9/18* (2013.01)

(58) Field of Classification Search

CPC ..... E02F 9/0891; E02F 9/0866; E02F 3/325; E02F 9/18; E02F 9/0833

See application file for complete search history.

(56) References Cited

U.S. PATENT DOCUMENTS 2,967,718 A * 1/1961 Orwig ..... E02F 9/18 280/759
4,402,413 A * 9/1983 Sickler ..... E02F 9/18 212/178

(Continued)

FOREIGN PATENT DOCUMENTS

CN 203402275 U 1/2014
CN 204492983 U 7/2015

(Continued)

OTHER PUBLICATIONS

Extended European Search Report issued in European Application No. 17922910.9 dated Mar. 25, 2020 (eight pages).

(Continued)

*Primary Examiner* — Edwin J Toledo-Duran
(74) *Attorney, Agent, or Firm* — Crowell & Moring LLP

(57) ABSTRACT

A cover mounting bracket (16) is provided on an upper side of a left weight part (11) and a right weight part (12) constituting a counterweight (10). The cover mounting bracket (16) is formed as a U-shaped frame with the counterweight (10) side open by a left extending member (17) extending forward from the upper side of the left weight part (11), a right extending member (18) extending forward from the upper side of the right weight part (12), and a connecting member (19) connecting the front side of the left extending member (17) and the front side of the right extending member (18). A prime mover cover (28) is supported on the connecting member (19) of the cover mounting bracket (16) rotatably in a vertical direction through a hinge (31). The prime mover cover (28) is moved between an open position where an inspection opening (15) of the counterweight (10) is opened and a closed position where the inspection opening (15) is closed around the hinge (31).

6 Claims, 8 Drawing Sheets

(56) References Cited

U.S. PATENT DOCUMENTS 5,462,309 A * 10/1995 Jeffers ..... E02F 9/18 187/222
5,833,268 A * 11/1998 Aldrovandi ..... E02F 9/18 280/759
5,975,833 A * 11/1999 Yamada ..... E02F 3/32 414/687
6,296,436 B1 * 10/2001 Ramun ..... E02F 9/18 212/195
6,481,748 B1 * 11/2002 Okuda ..... E02F 9/0833 280/755
9,890,020 B2 * 2/2018 Willim ..... B66C 23/76
2001/0007292 A1 * 7/2001 Yabf ..... F01P 11/12 180/68.1
2002/0062586 A1 * 5/2002 Kawamoto ..... E02F 9/18 37/466
2003/0056404 A1 * 3/2003 Iwasa ..... F02M 35/164 37/347
2004/0188166 A1 * 9/2004 Sugiyama ..... E02F 9/18 180/291
2005/0012314 A1 * 1/2005 Kubo ..... B62D 49/085 280/757
2007/0072063 A1 * 3/2007 Imashige ..... B62D 25/10 429/96
2008/0000704 A1 * 1/2008 Yonezawa ..... B62D 25/10 180/69.24
2008/0053944 A1 3/2008 Ramun
2010/0073479 A1 * 3/2010 Uto ..... E02F 9/18 348/148
2010/0236855 A1 * 9/2010 Matsushita ..... E02F 9/0866 180/69.2
2011/0219762 A1 * 9/2011 Kobayashi ..... F01P 11/12 60/456
2014/0021781 A1 * 1/2014 Satake ..... E02F 9/0866 307/9.1
2014/0124280 A1 * 5/2014 Kimura ..... B60H 1/00378 180/89.12
2015/0139768 A1 * 5/2015 Egawa ..... B66C 23/74 414/719
2016/0102593 A1 * 4/2016 Noguchi ..... E02F 9/2025 701/50
2016/0122976 A1 * 5/2016 Page ..... E02F 9/0866 414/719
2017/0073929 A1 3/2017 Tanaka et al.

FOREIGN PATENT DOCUMENTS

CN 105517848 A 4/2016
JP 2001-106479 A 4/2001
JP 2010-216156 A 9/2010
JP 2013-189765 A 9/2013
JP 2015-190123 A 11/2015

OTHER PUBLICATIONS

Chinese-language Office Action issued in Chinese Application No. 201780054543.3 dated Nov. 19, 2020 (8 pages).
International Search Report (PCT/ISA/220 & PCT/ISA/210) issued in PCT Application No. PCT/JP2017/035569 dated Dec. 12, 2017 (five pages).
Japanese-language Written Opinion (PCT/ISA/237) issued in PCT Application No. PCT/JP2017/035569 dated Dec. 12, 2017 (three pages).

* cited by examiner

CONSTRUCTION MACHINE

TECHNICAL FIELD

The present invention relates to a construction machine such as a hydraulic excavator and the like, for example, and particularly to a construction machine including a prime mover cover covering an prime mover.

BACKGROUND ART

A hydraulic excavator which is a typical construction machine is generally configured by an automotive lower traveling structure, an upper revolving structure mounted rotatably on the lower traveling structure, and a front device provided on a front side of the upper revolving structure. A counterweight which takes a weight balance with the front device is provided on a rear side of a revolving frame constituting the upper revolving structure.

Onboard devices such as the prime mover, a hydraulic pump, a heat exchanger and the like are mounted on a front side of the counterweight in the revolving frame, and these onboard devices are covered by the prime mover cover and an exterior cover.

As a counterweight according to the prior art, the counterweight with a U-shaped recess part provided at a center part in the left and right direction is known. The U-shaped recess part is an inspection opening for performing an inspection work for the prime mover. This counterweight is constituted by a left weight part located on a left side in the left and right direction, a right weight part located on a right side, and a lower weight part connecting lower sides of the left and right weight parts. The U-shaped recess part (inspection opening) surrounded by the left and right weight parts and the lower weight part is constituted to be covered by a bonnet, capable of being opened or closed (see, Patent Document 1).

PRIOR ART DOCUMENT

Patent Document

Patent Document 1: Japanese Patent Laid-Open No. 2013-189765 A

SUMMARY OF THE INVENTION

Here, the aforementioned counterweight according to the prior art has a left mounting part extending forward from an upper end of the left weight part and a right mounting part extending forward from an upper end of the right weight part. A bonnet stay extending in the left and right direction is mounted on these left and right mounting parts, and a bonnet is rotatably mounted on this bonnet stay through a hinge.

However, the counterweight according to the prior art has the left and right mounting parts extending forward from the upper ends of the right and left weight parts. Thus, a gravity center of the counterweight is moved to the front side only for the part of the left and right mounting parts, which incurs a problem that stability of a vehicle body is undermined.

Moreover, the bonnet according to the prior art is mounted on the bonnet stay mounted between the left and right weight parts of the counterweight through the hinge. Thus, since the bonnet stay is mounted on the left and right mounting parts, the inspection opening for inspecting the prime mover is narrowed by the bonnet stay, which incurs a problem that workability of the inspection work is lowered.

The present invention is made in view of the aforementioned problems of the prior art and has an object to provide a construction machine which suppresses movement of the gravity center of the counterweight to the front and can ensure a large inspection opening.

In order to solve the aforementioned problems, the present invention is applied to a construction machine constituted by an upper revolving structure mounted rotatably on a lower traveling structure and a front device provided on a front side of the upper revolving structure, in which the upper revolving structure includes a revolving frame, a counterweight provided on a rear side of the revolving frame in order to take a weight balance with the front device, and a prime mover mounted on the revolving frame by being located on the front side of the counterweight, the counterweight is constituted by a left weight part located on the left side in the left and right direction and rising upward from the revolving frame, a right weight part located on the right side in the left and right direction and rising upward from the revolving frame, a lower weight part connecting lower sides of the left weight part and the right weight part, and an inspection opening for inspecting the prime mover surrounded by the left weight part, the right weight part, and the lower weight part.

A feature of the present invention is that a cover mounting bracket connecting the left weight part and the right weight part is provided on an upper side of the left weight part and the right weight part constituting the counterweight; the cover mounting bracket is formed as a frame by a left extending member extending forward from an upper side of the left weight part, a right extending member extending forward from the upper side of the right weight part, and a connecting member connected to a front side of the left extending member and the front side of the right extending member and extending in the left and right direction; and a prime mover cover covering the inspection opening of the counterweight capable of opening or closing is mounted on the connecting member of the cover mounting bracket through a pivotal member.

According to the present invention, the prime mover cover is mounted on the connecting member of the cover mounting bracket extending forward from the left weight part and the right weight part. Thus, as compared with a case where a part of the counterweight is extended forward so as to mount the prime mover cover, movement of the gravity center of the counterweight to the front can be suppressed. Moreover, the cover mounting bracket is formed as a frame having the left and right extending members extending forward from the left and right weight parts and the connecting member connecting the front sides of the left and right extending members. Accordingly, a large work space can be ensured on the upper side of the inspection opening of the counterweight, and workability of the inspection work can be improved.

BRIEF DESCRIPTION OF THE DRAWINGS

FIG. 8 is a perspective view showing the cover mounting bracket, the prime mover cover, a spring member, a stopper and the like.

MODE FOR CARRYING OUT THE INVENTION

Figure 1:
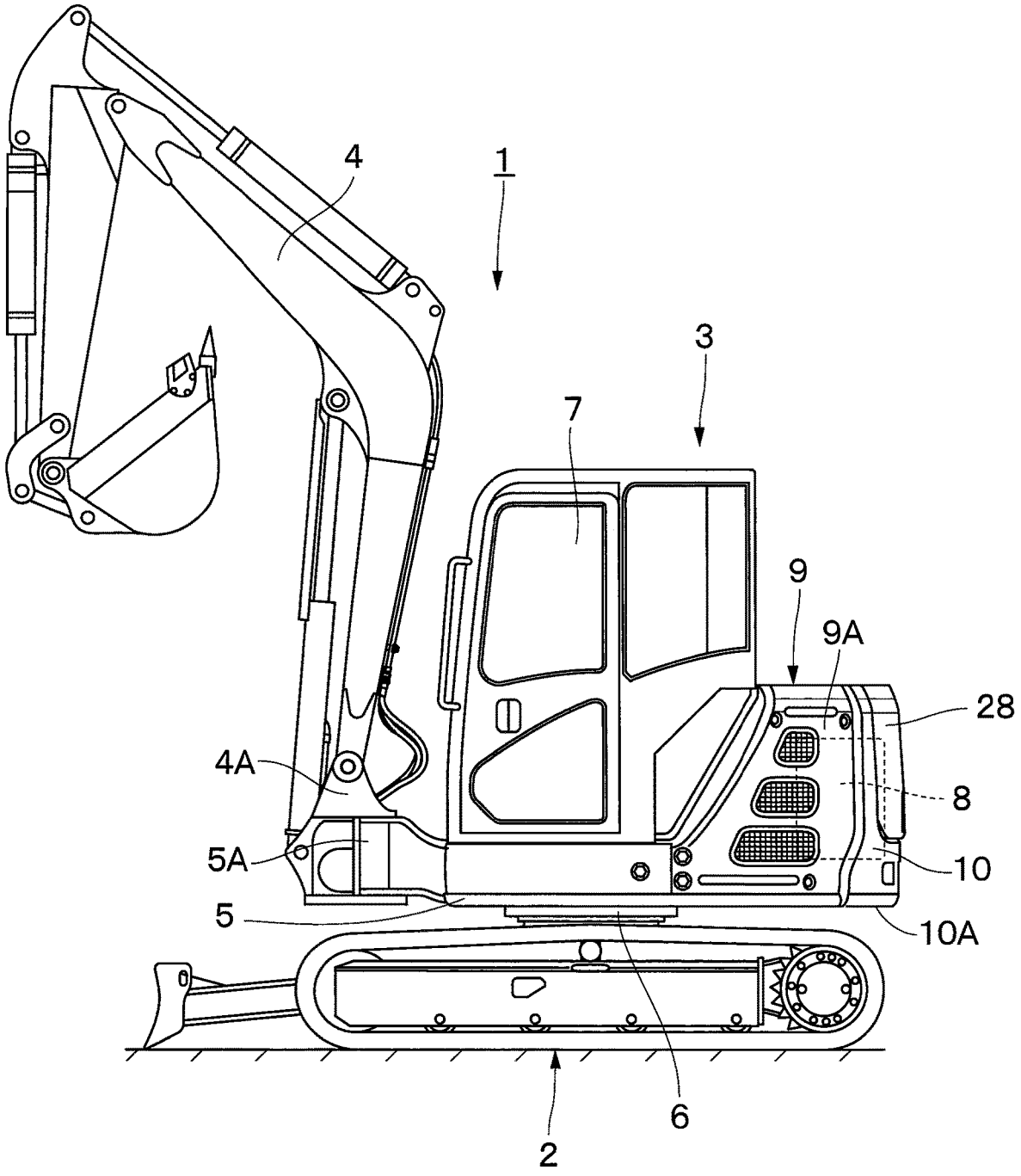
FIG. 1 is a front view showing a hydraulic excavator as a construction machine according to the embodiment of the present invention.

Hereinafter, an embodiment of a construction machine according to the present invention will be described below in detail by referring to the attached drawings by using a case applied to a hydraulic excavator as an example.

In the drawings, a body of a hydraulic excavator 1 is constituted by an automotive crawler-type lower traveling structure 2 and an upper revolving structure 3 rotatably mounted on the lower traveling structure 2. A swing-type front device 4 is provided capable of moving upward or downward at a center on a front part of the upper revolving structure 3. A swing post 4A is provided on a base end side of the front device 4, and the swing post 4A is supported by a swing bracket 5A which will be described later, capable of swing in the left and right direction. Therefore, the front device 4 is constituted to be mounted capable of swing in the left and right direction with respect to the upper revolving structure 3 and capable of moving upward or downward in a vertical direction and to perform an excavating work of earth and sand.

The upper revolving structure 3 has a revolving frame 5 as a body frame. The revolving frame 5 is rotatably mounted on the lower traveling structure 2 through a revolving device 6. A cylindrical swing bracket 5A is mounted on a front end side of the revolving frame 5, and the swing bracket 5A supports a swing post 4A of the front device 4, capable of swing in the left and right direction. A cab 7 defining an operator's room is provided on a left front side of the revolving frame 5.

Figure 4:
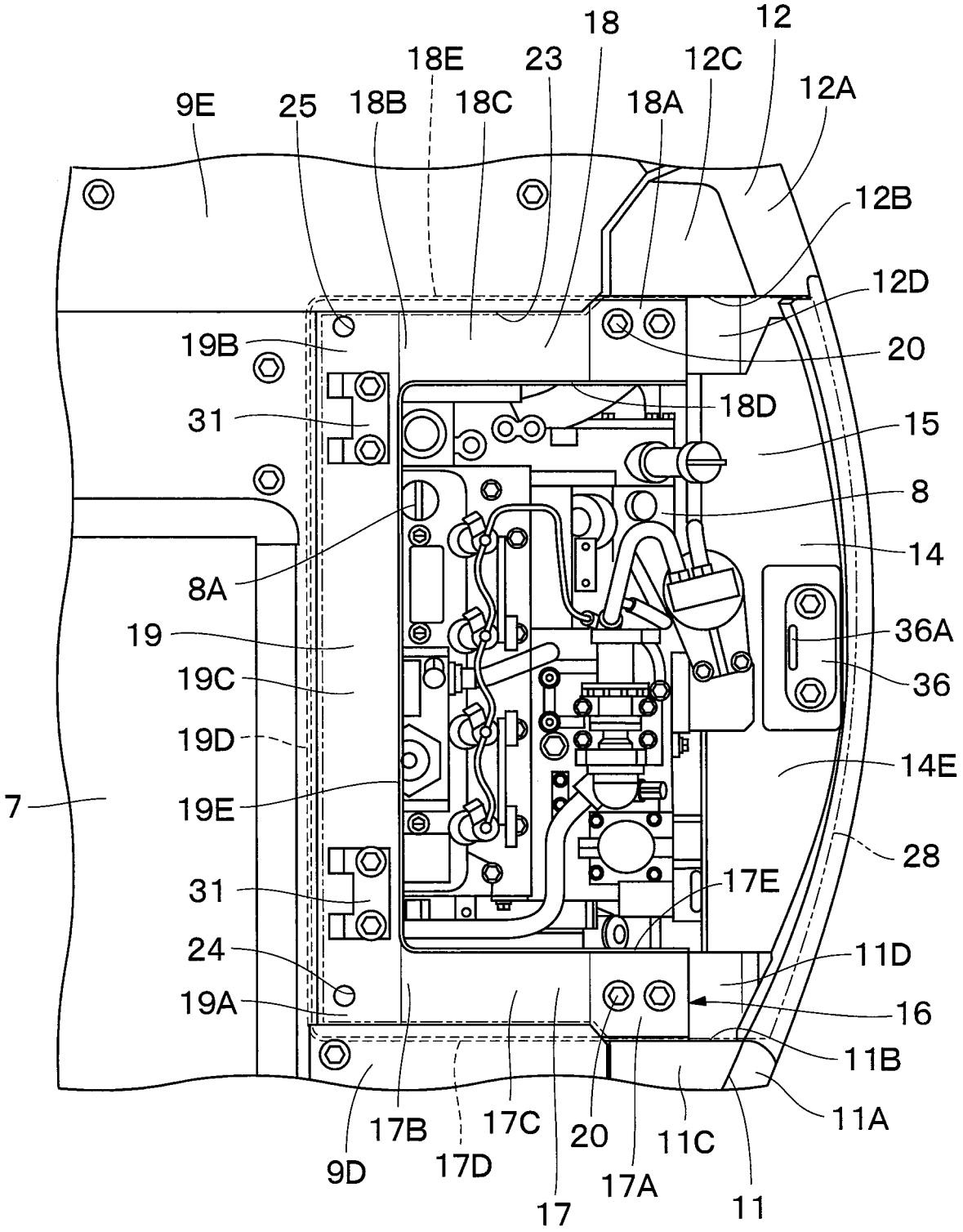
FIG. 4 is a plan view of an exterior cover, a prime mover, a counterweight, a cover mounting bracket and the like when seen from above in a state where the prime mover cover is removed.

A counterweight 10 which will be described later and takes a weight balance with the front device 4 is provided on a rear end side of the revolving frame 5. Moreover, an engine 8 as a prime mover is mounted in a laterally placed state extending in the left and right direction closer to a front side than the counterweight 10 in the revolving frame 5. As shown in FIG. 4, a fuel filling port 8A is provided at an upper position of the engine 8. Lubricant oil (engine oil) is supplied to the engine 8 through the fuel filling port 8A during an inspection work for the engine 8.

Further, an exterior cover 9 covering onboard devices such as a prime mover cover 28 which will be described later and covers the engine 8 disposed on the revolving frame 5 from rear and above, a hydraulic pump including the engine 8, and a heat exchanger (none of them is shown) and the like is provided on the upper revolving structure 3. The exterior cover 9 is constituted by a left side surface cover 9A covering the onboard devices such as the engine 8 and the like from the left side, a right side surface cover 9B covering the onboard devices from the right side, and an upper surface cover 9C disposed so as to surround an upper surface plate 29 of the prime mover cover 28 and covering the onboard devices from above. The upper surface cover 9C has a left upper surface cover 9D disposed adjacent to the left side of the later described upper surface plate 29 constituting the prime mover cover 28 and a right upper surface cover 9E disposed adjacent to the right side of the upper surface plate 29.

Figure 5:
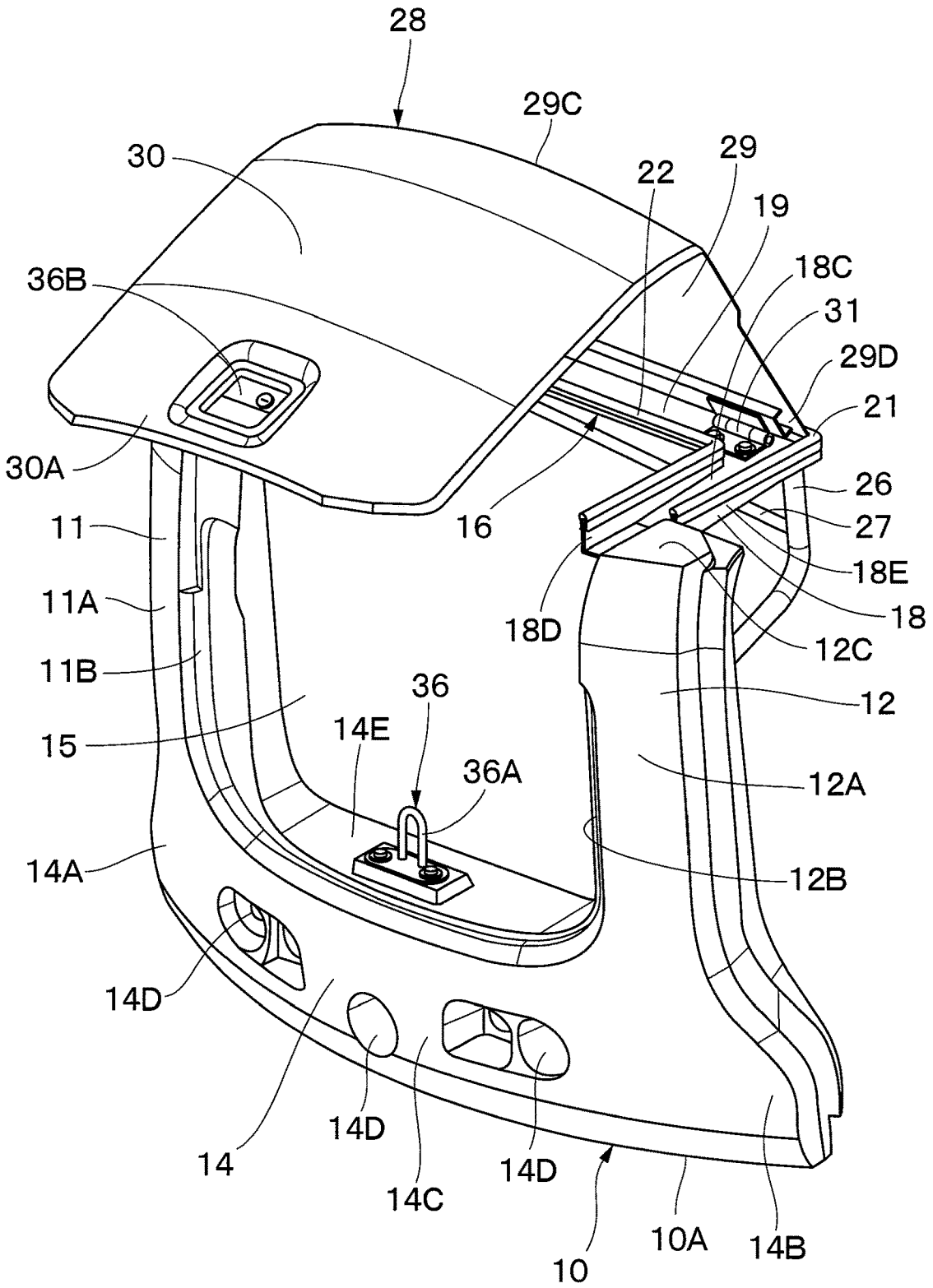
FIG. 5 is a perspective view of the counterweight, the cover mounting bracket, the prime mover cover and the like when seen from rear of the counterweight.
Figure 6:
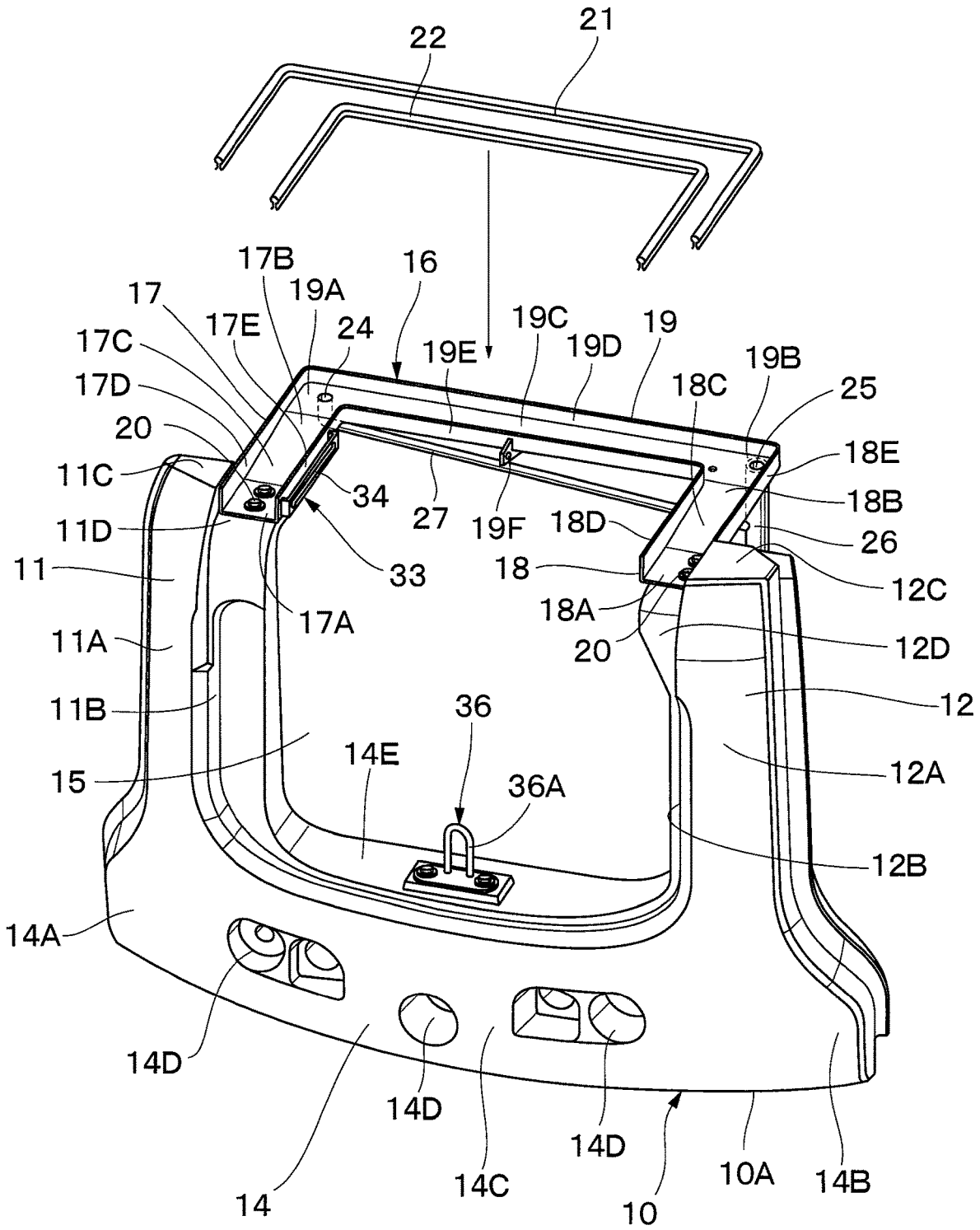
FIG. 6 is an exploded perspective view of the counterweight, the cover mounting bracket, a seal material and the like when seen from rear of the counterweight.
Figure 7:
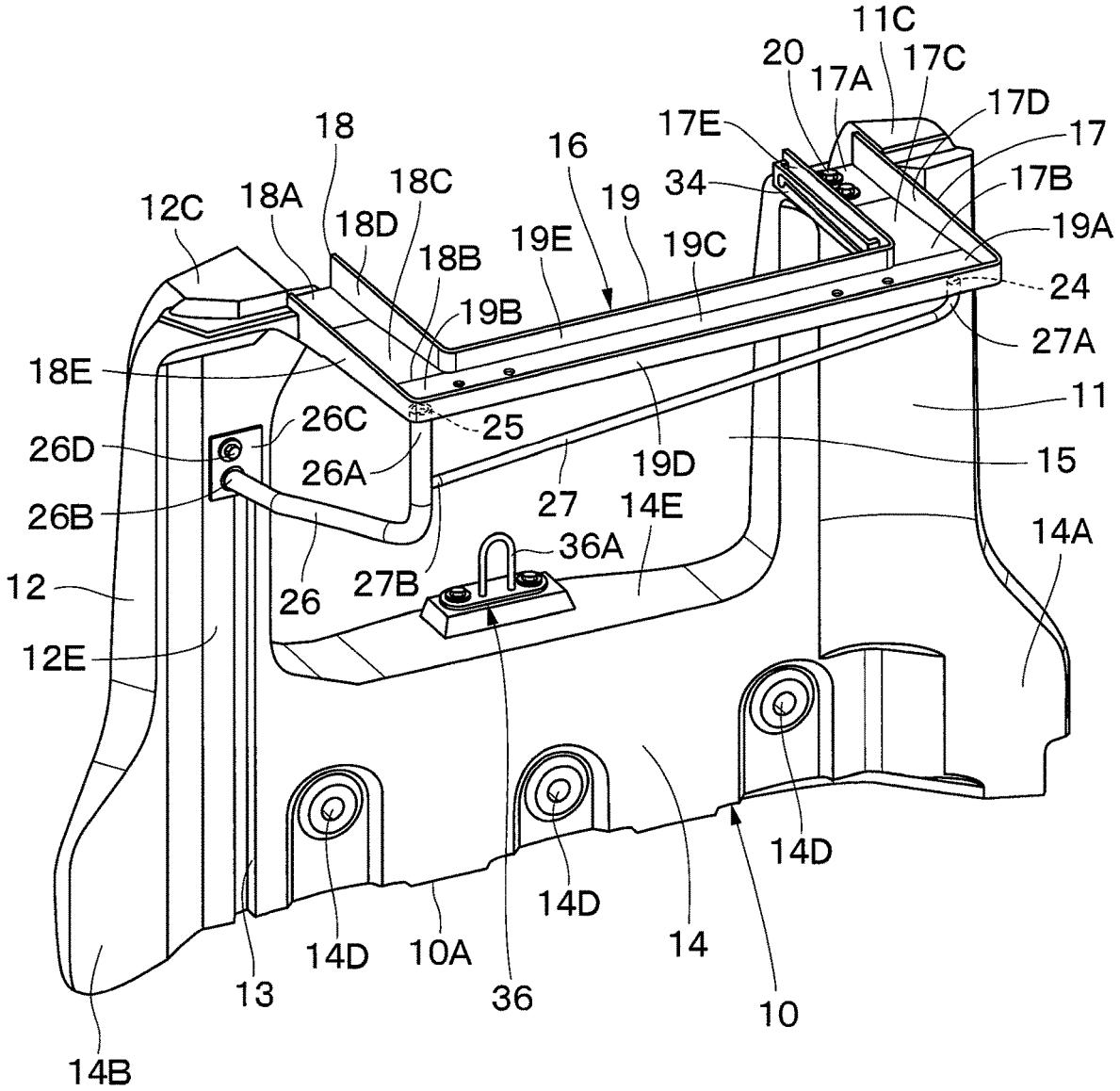
FIG. 7 is a perspective view of the counterweight, the cover mounting bracket, a drainage pipe, a drainage groove and the like when seen from front of the counterweight.

Subsequently, the counterweight 10 used in this embodiment will be described by referring to FIG. 5 to FIG. 7.

The counterweight 10 is provided on a rear end side of the revolving frame 5 and takes a weight balance with the front device 4. Here, the counterweight 10 is constituted by including a left weight part 11 which will be described later, a right weight part 12, a lower weight part 14, and an inspection opening 15 and is formed integrally as a heavy article curved having an arc shape and extending in the left and right direction.

The left weight part 11 of the counterweight 10 is disposed on the left side in the left and right direction of the counterweight 10 and rises upward from the revolving frame 5. A rear surface 11A of the left weight part 11 is a curved surface curved having an arc shape and smoothly continues to an outer side surface of the left side surface cover 9A constituting the exterior cover 9. A recessed surface 11B recessed to an inner side (the engine 8 side) from the rear surface 11A on the right side of the left weight part 11. A step for accommodating a later described rear surface plate 30 constituting the prime mover cover 28 is formed between the rear surface 11A and the recessed surface 11B of the left weight part 11. As a result, when the prime mover cover 28 is at a closed position shown in FIG. 2, the rear surface plate 30 of the prime mover cover 28 and the rear surface 11A of the left weight part 11 are constituted to smoothly continue to each other.

An upper end of the left weight part 11 is a flat upper end surface 11C. A bracket mounting surface 11D recessed to a lower side from the upper end surface 11C is provided adjacently on the right side of the upper end surface 11C. A left extending member 17 of a cover mounting bracket 16 which will be described later is mounted on this bracket mounting surface 11D. Here, a step in the vertical direction corresponding to a height dimension of the left extending member 17 is formed between the upper end surface 11C and the bracket mounting surface 11D. As a result, when the prime mover cover 28 is at a closed position, the upper surface plate 29 of the prime mover cover 28 and the upper end surface 11C of the left weight part 11 are constituted to form the same plane.

The right weight part 12 of the counterweight 10 is disposed on the right side in the left and right direction of the counterweight 10 and rises upward from the revolving frame 5. The rear surface 12A of the right weight part 12 is a curved surface having a curved arc shape and smoothly continues to an outer side surface of the right side surface cover 9B constituting the exterior cover 9. A recessed surface 12B recessed to the inner side from the rear surface 12A is provided on the left side of the right weight part 12. A step accommodating the rear surface plate 30 of the prime mover cover 28 is formed between the rear surface 12A and the recessed surface 12B of the right weight part 12. As a result, when the prime mover cover 28 is at the closed position shown in FIG. 2, the rear surface plate 30 of the prime mover cover 28 and the rear surface 12A of the right weight part 12 are constituted to smoothly continue to each other.

An upper end of the right weight part 12 is a flat upper end surface 12C. A bracket mounting surface 12D recessed to a lower side from the upper end surface 12C is provided adjacently on the left side of the upper end surface 12C. Aright extending member 18 of the cover mounting bracket 16 which will be described later is mounted on this bracket mounting surface 12D. Here, a step in the vertical direction corresponding to a height dimension of the right extending member 18 is formed between the upper end surface 12C and the bracket mounting surface 12D. As a result, when the prime mover cover 28 is at the closed position, the upper surface plate 29 of the prime mover cover 28 and the upper end surface 12C of the right weight part 12 are constituted to form the same plane.

A drainage groove 13 is provided in an inner side surface 12E faced with the engine 8 in the right weight part 12. As shown in FIG. 7, the drainage groove 13 is formed linearly along the right weight part 12 by cutting away the inner side surface 12E of the right weight part 12 in the vertical direction. The other end 26B of a drainage pipe 26 is connected to an upper end side of the drainage groove 13, and a lower end of the drainage groove 13 is opened in a lower end 10A of the counterweight 10. That is, the drainage groove 13 is cut away downward from a portion where the other end 26B of the drainage pipe 26 is connected.

The lower weight part 14 of the counterweight 10 is disposed on the lower side of the counterweight 10 connects the lower sides of the left weight part 11 and the right weight part 12. A left end part 14A of the lower weight part 14 extends to the left side more than a left end edge of left weight part 11, and a right end part 14B of the lower weight part 14 extends to the right side more than the right end edge of a right weight part 12. A rear surface 14C of the lower weight part 14 is a curved surface curved having an arc shape and smoothly continues to the outer side surface of the left side surface cover 9A and the right side surface cover 9B constituting the exterior cover 9.

A plurality of (three pieces, for example) bolt insertion holes 14D penetrating the lower weight part 14 in a longitudinal direction is formed in the lower weight part 14. Each of these bolt insertion holes 14D is through which a bolt (not shown) for fixing the counterweight 10 to the revolving frame 5 is inserted. A hook member 36A of a lock mechanism 36 which will be described later is provided on an upper end surface 14E of the lower weight part 14 located between the left weight part 11 and the right weight part 12. A height dimension from the lower end 10A of the counterweight 10 to the upper end surface 14E of the lower weight part 14 is set smaller than the height dimension from the lower end 10A of the counterweight 10 to the upper end surface 11C of the left weight part 11 and the height dimension to the upper end surface 12C of the right weight part 12. As a result, the inspection opening 15 which will be described later is formed on an upper side than the upper end surface 14E of the lower weight part 14.

Figure 2:
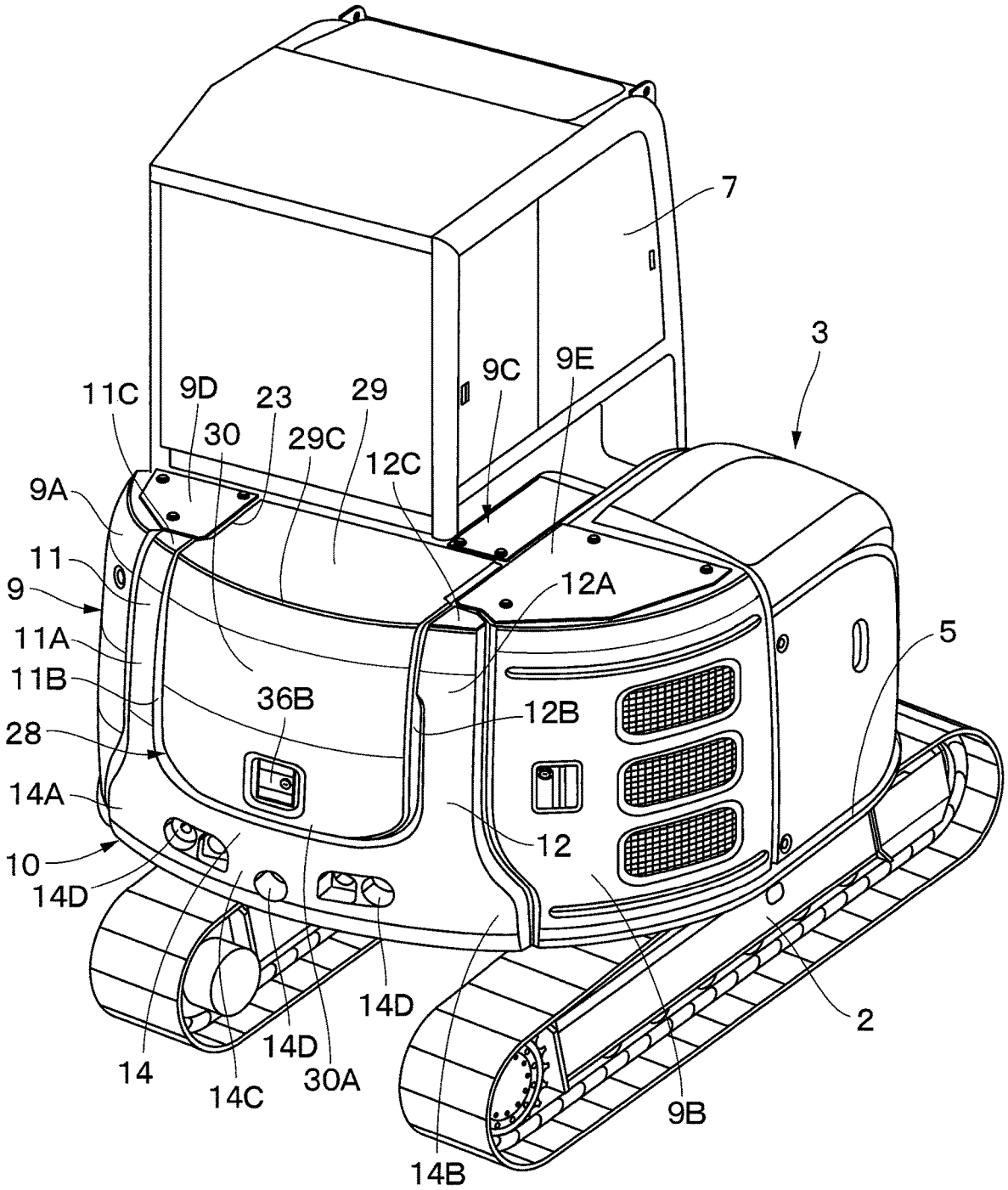
FIG. 2 is a perspective view of the hydraulic excavator when seen from rear right in a state where a prime mover cover is closed.
Figure 3:
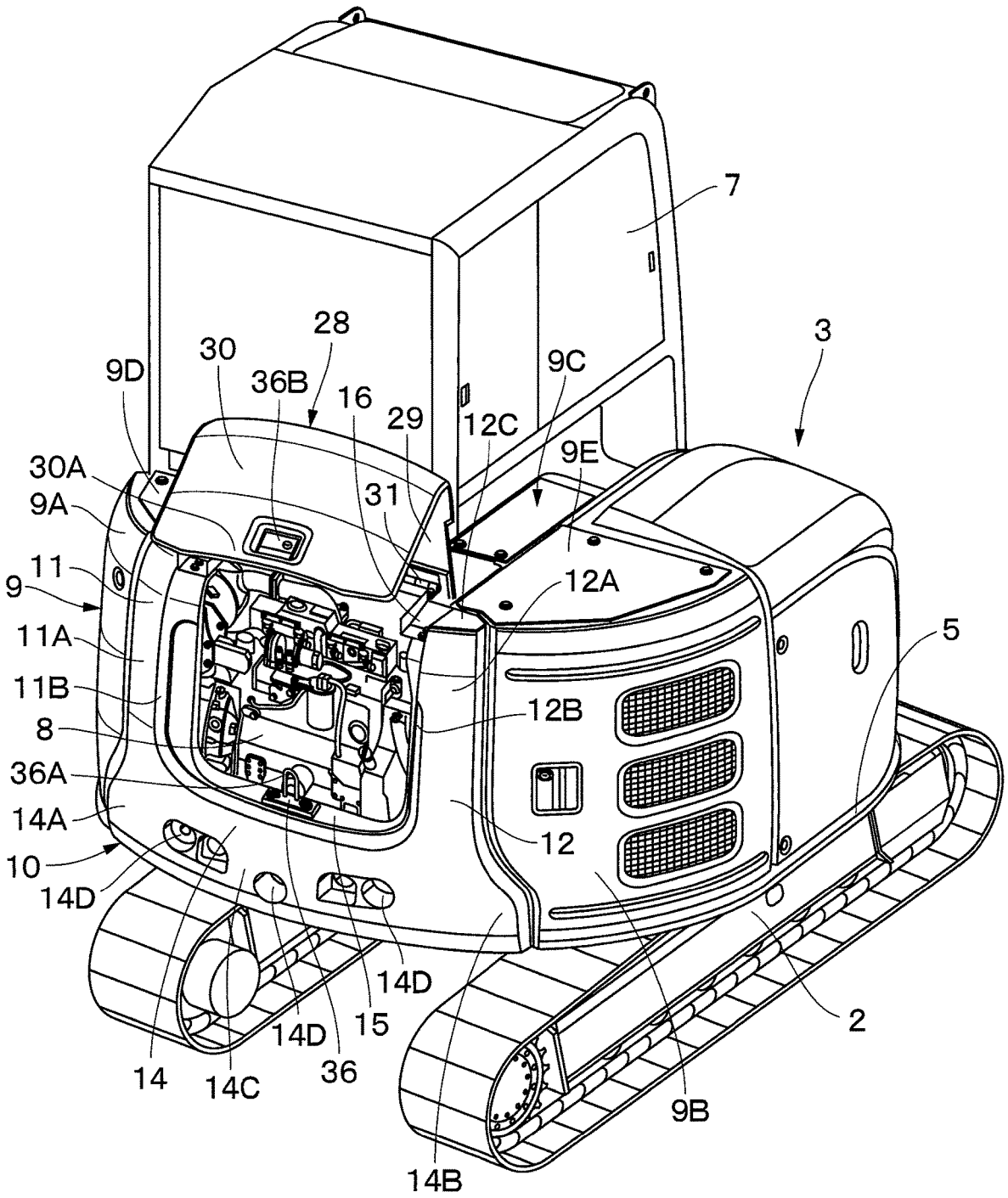
FIG. 3 is a perspective view of the hydraulic excavator when seen from rear right in a state where a prime mover cover is opened.

The inspection opening 15 is provided within a range surrounded by the left weight part 11, the right weight part 12, and the lower weight part 14. That is, the inspection opening 15 is made of a rectangular opening formed at the center part in the left and right direction of the counterweight 10, and as shown in FIGS. 2 and 3, it is opened or closed by the prime mover cover 28. Accordingly, it is configured such that, when the prime mover cover 28 is moved to an open position shown in FIG. 3, the inspection work can be performed for the onboard devices such as the engine 8 and the like through the inspection opening 15 of the counterweight 10.

Subsequently, the cover mounting bracket 16 applied to this embodiment will be described.

The cover mounting bracket 16 is provided on the upper sides of the left weight part 11 and the right weight part 12 constituting the counterweight 10. The cover mounting bracket 16 is formed by the left extending member 17, the right extending member 18, and the connecting member 19 as a frame having a U-shape with the counterweight 10 side open on a plan view. The cover mounting bracket 16 extends to the front of the counterweight 10 and supports the prime mover cover 28, capable of opening or closing on the front side of the inspection opening 15 provided in the counterweight 10. Moreover, the cover mounting bracket 16 receives rainwater, washing water or the like falling from an outer peripheral edge of the prime mover cover 28 and for discharging the rainwater or the like to the counterweight 10 side.

The left extending member 17 extends forward (engine 8 side) from the upper side of the left weight part 11. That is, a rear end 17A of the left extending member 17 is mounted on the bracket mounting surface 11D of the left weight part 11 by using a bolt 20, and a front end 17B of the left extending member 17 extends forward from the bracket mounting surface 11D.

The left extending member 17 is constituted by a bottom plate 17C extending in the longitudinal direction, a left side plate 17D bent upward from the left end of the bottom plate 17C, and a right side plate 17E bent upward from the right end of the bottom plate 17C. The left side plate 17D and the right side plate 17E are faced with each other at a certain interval. Accordingly, the left extending member 17 is formed as a bottomed gutter-shaped body with an upper side open. The bottom plate 17C of the left extending member 17 has the front end 17B side (connecting member 19 side) high and the rear end 17A side (counterweight 10 side) low. That is, the bottom plate 17C forms an inclined bottom surface having a backwardly descending gradient. As a result, when rainwater or the like falls into the left extending member 17, the rainwater or the like is led by the inclination of the bottom plate 17C to the left weight part 11 and is discharged to the lower end 10A of the counterweight 10 along the left weight part 11.

The right extending member 18 extends forward from the upper side of the right weight part 12. That is, a rear end 18A of the right extending member 18 is mounted on the bracket mounting surface 12D of the right weight part 12 by using the bolt 20, and a front end 18B of the right extending member 18 extends forward from the bracket mounting surface 12D.

The right extending member 18 is constituted by a bottom plate 18C extending in the longitudinal direction, a left side plate 18D bent upward from a left end of the bottom plate 18C, and a right side plate 18E bent upward from a right end of the bottom plate 18C. The left side plate 18D and the right side plate 18E are faced with each other at a certain interval. Accordingly, the right extending member 18 is formed as a bottomed gutter-shaped body with the upper side open. The bottom plate 18C of the right extending member 18 has the front end 18B side (connecting member 19 side) high and the rear end 18A side (counterweight 10 side) low. That is, the bottom plate 18C forms an inclined bottom surface having a backwardly descending gradient. As a result, when rainwater or the like falls into the right extending member 18, the rainwater or the like is led by the inclination of the bottom plate 18C to the right weight part 12 and is discharged to the lower end 10A of the counterweight 10 along the right weight part 12.

The connecting member 19 connects the front end 17B of the left extending member 17 and the front end 18B of the right extending member 18 and extends in the left and right direction. That is, a left end 19A of the connecting member 19 is connected to the front end 17B of the left extending member 17, and a right end 19B of the connecting member 19 is connected to the front end 18B of the right extending member 18. As a result, the cover mounting bracket 16 is formed as a frame having a U-shape on a plan view with the counterweight 10 side (rear side) open.

The connecting member 19 is constituted by a bottom plate 19C extending in the left and right direction, a front side plate 19D bent upward from a front end of the bottom plate 19C, and a rear side plate 19E bent upward from a rear end of the bottom plate 19C. The front side plate 19D and the rear side plate 19E are faced with each other at a certain interval. As a result, the connecting member 19 is formed as a bottomed gutter-shaped body with the upper side open. A bracket-side spring support plate 19F is projected rearward from the rear side plate 19E at a center part in the left and right direction of the rear side plate 19E. This bracket-side spring support plate 19F is on which one end 32A of a spring member 32 which will be described later is mounted (see FIG. 8).

Here, the upper end of the front side plate 19D of the connecting member 19 is disposed on the same plane as the upper ends of the left side plate 17D of the left extending member 17 and the right side plate 18E of the right extending member 18. A front-side seal material 21 bent in a U-shape on a plan view is mounted on the upper ends of these front side plate 19D, the left side plate 17D, and the right side plate 18E. Moreover, the upper end of the rear side plate 19E of the connecting member 19 is disposed on the same plane as the upper ends of the right side plate 17E of the left extending member 17 and the left side plate 18D of the right extending member 18. A rear-side seal material 22 bent in a U-shape on a plan view is mounted on the upper ends of these rear side plate 19E, the right side plate 17E, and the left side plate 18D. These front-side seal material 21 and rear-side seal material 22 are brought into contact with an inner side surface of the upper surface plate 29 and for sealing a gap between the upper surface plate 29 and the cover mounting bracket 16 in a liquid tight manner when the prime mover cover 28 is held at the closed position.

The rear end 17A of the left extending member 17 is mounted on the bracket mounting surface 11D of the left weight part 11, and the rear end 18A of the right extending member 18 is mounted on the bracket mounting surface 12D of the right weight part 12. As a result, the cover mounting bracket 16 is mounted by extending to the front of the counterweight 10. In this state, the connecting member 19 connecting the front end 17B of the left extending member 17 and the front end 18B of the right extending member 18 is disposed above the engine 8 disposed on the front side of the counterweight 10.

Here, the connecting member 19 of the cover mounting bracket 16 connects the left extending member 17 and the right extending member 18 at a position closer to the front side (cab 7 side) than the fuel filling port 8A provided at the upper position of the engine 8. As a result, a work for supplying the lubricant oil to the fuel filling port 8A of the engine 8 is not hindered by the connecting member 19. Moreover, the cover mounting bracket 16 is formed having a U-shape with the counterweight 10 side open and extends forward from the upper side of the counterweight 10. Thus, a large work space is formed above the inspection opening 15 of the counterweight 10.

The prime mover cover 28 is mounted on the connecting member 19 of the cover mounting bracket 16 rotatably in the vertical direction through a hinge 31 which will be described later. At this time, as shown in FIG. 4, the cover mounting bracket 16 is disposed at a position covering a boundary part 23 between the upper surface cover 9C of the exterior cover 9 and the prime mover cover 28 from below. As a result, even if rain water or the like enters into a gap formed in the boundary part 23 between the upper surface cover 9C and the prime mover cover 28, the rainwater or the like is accommodated in the cover mounting bracket 16 having a gutter shape. The rainwater or the like accommodated in the cover mounting bracket 16 is discharged to the counterweight 10 side along the bottom plates 17C and 18C of the left and right extending members 17 and 18 which are inclined bottom surfaces. As described above, the cover mounting bracket 16 has a function of supporting the prime mover cover 28, capable of opening or closing on the front side of the inspection opening 15 and a function of discharging the rainwater or the like falling from the prime mover cover 28 to the counterweight 10 side.

A left drainage hole 24 is provided on the left end 19A side of the bottom plate 19C constituting the connecting member 19 and penetrates the bottom plate 19C in the vertical direction. A right drainage hole 25 is provided on the right end 19B side of the bottom plate 19C and penetrates the bottom plate 19C in the vertical direction. Here, the body of the hydraulic excavator 1 takes a posture (front inclined posture) inclined so that the front side (front device 4 side) is low in some cases. When the body of the hydraulic excavator 1 takes the front inclined attitude, the rainwater or the like falling into the cover mounting bracket 16 is collected in the connecting member 19. The left and right drainage holes 24 and 25 are for draining the rainwater or the like collected in the connecting member 19.

The drainage pipe 26 as a pipe body is provided between the right drainage hole 25 formed in the connecting member 19 of the cover mounting bracket 16 and the counterweight 10. The drainage pipe 26 is for leading rainwater or the like discharged from the connecting member 19 through the right drainage hole 25 to the counterweight 10. As shown in FIG. 7, the drainage pipe 26 is formed by a metal pipe bent in an L-shape. One end 26A of the drainage pipe 26 is fixed to the lower surface of the bottom plate 19C constituting the connecting member 19 by using means such as welding and the like and is connected to the right drainage hole 25.

On the other hand, a flange plate 26C having a flat plate shape is fixed to the other end 26B of the drainage pipe 26. The flange plate 26C is mounted on the inner side surface 12E of the right weight part 12 by using a bolt 26D. Here, the drainage groove 13 extending in the vertical direction is formed in the inner side surface 12E of the right weight part 12. The other end 26B of the drainage pipe 26 is connected to an upper end side of the drainage groove 13 at a position lower than the one end 26A.

An auxiliary drainage pipe 27 is provided between the left drainage hole 24 formed in the connecting member 19 of the cover mounting bracket 16 and the drainage pipe 26. The auxiliary drainage pipe 27 is for leading the rainwater or the like drained from the connecting member 19 through the left drainage hole 24 to the drainage pipe 26. The auxiliary drainage pipe 27 is formed linearly by a metal pipe having a diameter smaller than that of the drainage pipe 26, for example. One end 27A of the auxiliary drainage pipe 27 is fixed to the lower surface of the bottom plate 19C constituting the connecting member 19 by using means such as welding and the like and is connected to the left drainage hole 24. On the other hand, the other end 27B of the auxiliary drainage pipe 27 is connected to a middle portion of the drainage pipe 26.

Accordingly, in the case where the body of the hydraulic excavator 1 takes a front inclined attitude and rainwater or the like is collected in the connecting member 19 of the cover mounting bracket 16, the rainwater or the like is drained from the connecting member 19 through the left drainage hole 24 and the right drainage hole 25. The rainwater or the like drained from the right drainage hole 25 flows into the drainage pipe 26, and the rainwater or the like drained from the left drainage hole 24 flows into the drainage pipe 26 through the auxiliary drainage pipe 27. The rainwater or the like having flowed into the drainage pipe 26 is led to the drainage groove 13 of the counterweight 10 (right weight part 12) through the other end 26B of the drainage pipe 26 and is drained to the lower end 10A of the counterweight 10 along the drainage groove 13.

Here, the drainage pipe 26 also works as a strength member supporting the connecting member 19 of the cover mounting bracket 16 from below. As a result, mounting strength of the cover mounting bracket 16 extending to the front of the counterweight 10 to the counterweight 10 can be improved. Accordingly, the prime mover cover 28 is supported stably by the cover mounting bracket 16.

Subsequently, the prime mover cover 28 applied to this embodiment will be described.

The prime mover cover 28 is mounted on the cover mounting bracket 16 and covers the inspection opening 15 of the counterweight 10, capable of opening or closing. That is, the prime mover cover 28 is mounted on the connecting member 19 of the cover mounting bracket 16 through the hinge 31 which will be described later. The prime mover cover 28 is rotationally moved (moved) in the vertical direction between the open position (position in FIG. 3) where the inspection opening 15 is opened and the closed position (position in FIG. 2) where the inspection opening 15 is closed. Here, the prime mover cover 28 has the upper surface plate 29 covering the inspection opening 15 from above and the rear surface plate 30 covering the inspection opening 15 from backward.

The upper surface plate 29 of the prime mover cover 28 is formed in a flat plate shape extending in the left and right direction between the left upper surface cover 9D and the right upper surface cover 9E of the exterior cover 9. The upper surface plate 29 forms the same plane as the left upper surface cover 9D, the right upper surface cover 9E, the upper end surface 11C of the left weight part 11, and the upper end surface 12C of the right weight part 12 when the prime mover cover 28 is at the closed position.

Figure 8:
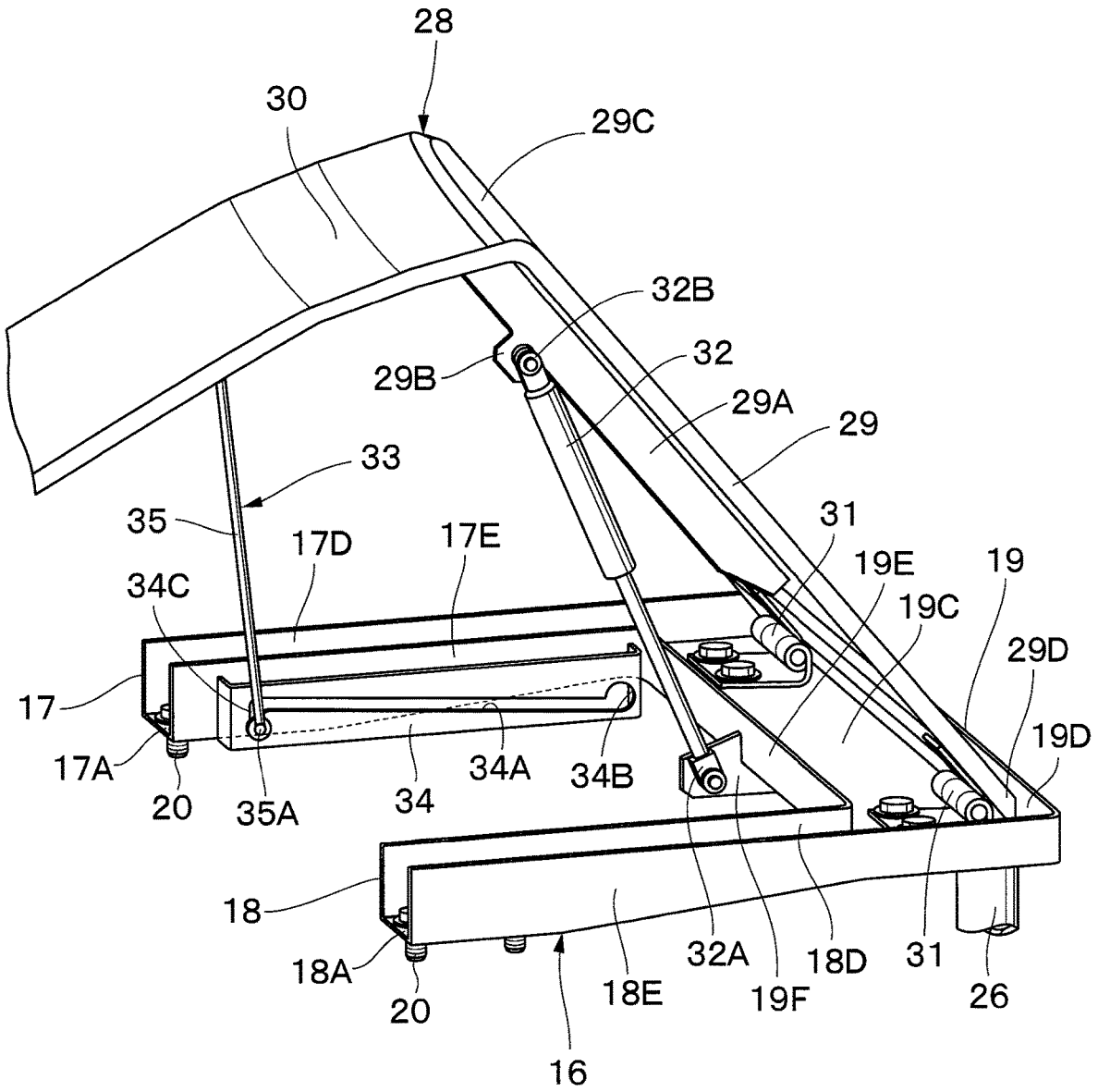

As shown in FIG. 8, a reinforcing plate 29A extending in the longitudinal direction is provided on the inner side surface faced with the engine 8 in the upper surface plate 29. A cover-side spring support plate 29B is projected at the middle portion in the length direction of the reinforcing plate 29A. The other end 32B of the spring member 32 which will be described later is mounted on this cover-side spring support plate 29B.

The rear surface plate 30 of the prime mover cover 28 extends downward from a rear end 29C of the upper surface plate 29. The rear surface plate 30 has a curved shape similar to the rear surfaces 11A and 12A of the left and right weight parts 11 and 12 and the rear surface 14C of the lower weight part 14. As a result, the rear surface plate 30 smoothly continues to the rear surfaces 11A and 12A of the left and right weight parts 11 and 12 and the rear surface 14C of the lower weight part 14 when the prime mover cover 28 is at the closed position.

The hinges 31 as pivotal members are provided in two pieces separated in the left and right direction between a front end 29D of the upper surface plate 29 of the prime mover cover 28 and the bottom plate 19C of the connecting member 19. That is, both left and right sides of the front end 29D of the upper surface plate 29 are supported by the connecting member 19 through the hinges 31, respectively. As a result, the prime mover cover 28 can be rotationally moved in the vertical direction between the open position (position in FIG. 3) where the inspection opening 15 is opened and the closed position (position in FIG. 2) where the inspection opening 15 is closed around the hinges 31.

As described above, the prime mover cover 28 is supported rotatably by the connecting member 19 of the cover mounting bracket 16 extending to the front of the counterweight 10 through the hinge 31. Thus, there is no need in the counterweight 10 to provide left and right mounting parts extending to the front from the upper ends of the left and right weight parts as in the counterweight according to the prior art, for example. Accordingly, the gravity center of the counterweight 10 is held on the rear side.

The spring member 32 is provided between the cover mounting bracket 16 and the prime mover cover 28. As shown in FIG. 8, the spring member 32 is constituted by a gas spring, for example. The one end 32A of the spring member 32 is mounted on the bracket-side spring support plate 19F provided on the connecting member 19 of the cover mounting bracket 16. The other end 32B of the spring member 32 is mounted on the cover-side spring support plate 29B provided on the upper surface plate 29 of the prime mover cover 28. The spring member 32 is extended or contracted with an opening or closing operation of the prime mover cover 28 around the hinge 31 and assists the operation of the prime mover cover 28.

A stopper 33 is provided between the cover mounting bracket 16 and the prime mover cover 28. The stopper 33 is constituted by a guide plate 34 provided on the left extending member 17 of the cover mounting bracket 16 and a rod-shaped body 35 provided between the guide plate 34 and the prime mover cover 28. The prime mover cover 28 is held at the open position by the stopper 33 after it is moved to the open position by assistance of the spring member 32.

The guide plate 34 of the stopper 33 extends in the longitudinal direction while being faced with the right side plate 17E of the left extending member 17. The guide plate 34 is formed having a U-shape with the both sides in the length direction bent toward the right side plate 17E. The both ends in the length direction of the guide plate 34 are fixed to the right side plate 17E by using means such as welding. A linear guide hole 34A extending in the longitudinal direction while being inclined diagonally upward toward the rear is formed in the guide plate 34. The guide hole 34A is slidably engaged with the rod-shaped body 35. A front end of the guide hole 34A is a closed-position engagement part 34B, and a rear end of the guide hole 34A is an open-position engagement part 34C.

The rod-shaped body 35 of the stopper 33 is provided between the prime mover cover 28 and the guide hole 34A of the guide plate 34. One end (not shown) of the rod-shaped body 35 is mounted on the inner side surface in the prime mover cover 28 faced with the engine 8 rotatably in the longitudinal direction. The other end 35A of the rod-shaped body 35 is slidably engaged as a free end movable in the longitudinal direction in the guide hole 34A. The other end 35A of the rod-shaped body 35 slides in the guide hole 34A with the opening or closing operation of the prime mover cover 28. When the prime mover cover 28 is moved to the closed position, the other end 35A of the rod-shaped body 35 is engaged with the closed-position engagement part 34B of the guide hole 34A. On the other hand, when the prime mover cover 28 is moved to the open position, the other end 35A of the rod-shaped body 35 is engaged with the open-position engagement part 34C of the guide hole 34A (see FIG. 8). As a result, the prime mover cover 28 having moved to the open position can be supported by the rod-shaped body 35 and the prime mover cover 28 can be held at the open position.

The lock mechanism 36 is provided between the counterweight 10 and the rear surface plate 30 of the prime mover cover 28. That is, the lock mechanism 36 is constituted by the hook member 36A having an inverted U-shape installed upright on the upper end surface 14E of the lower weight part 14 and a catch member 36B provided on the lower end 30A side of the rear surface plate 30. An engagement claw (not shown) capable of engagement and disengagement with respect to the hook member 36A is provided on a portion in the catch member 36B corresponding to the hook member 36A. The prime mover cover 28 is held at the closed position by engagement of the engagement claw of the catch member 36B with the hook member 36A.

The hydraulic excavator 1 according to this embodiment has the constitution as described above, and the hydraulic excavator 1 is self-propelled to a work site by the lower traveling structure 2 and performs the excavating work of earth and sand by using the front device 4.

Here, the inspection work for the engine 8 and the like mounted on the hydraulic excavator 1 will be described. When the inspection work is to be performed, a worker operates the lock mechanism 36 provided on the prime mover cover 28 and disengages the catch member 36B and the hook member 36A. In this state, the worker lifts the lower end of the prime mover cover 28 upward. As a result, the prime mover cover 28 is rotationally moved (opening operation) upward around the hinge 31. At this time, the spring member 32 provided between the cover mounting bracket 16 and the prime mover cover 28 is extended, and the opening operation of the prime mover cover 28 around the hinge 31 is assisted.

As a result, the worker can move the prime mover cover 28 from the closed position to the open position easily and can rapidly open the inspection opening 15 of the counterweight 10. When the prime mover cover 28 is moved to the open position, the other end 35A of the rod-shaped body 35 constituting the stopper 33 is engaged with the open-position engagement part 34C of the guide hole 34A formed in the guide plate 34 as shown in FIG. 8. Accordingly, the prime mover cover 28 having been moved to the open position can be held at the open position in a state supported by the rod-shaped body 35.

In the state where the prime mover cover 28 is held at the open position, the worker performs the inspection work for the engine 8 and the like through the inspection opening 15 of the counterweight 10. In this case, the connecting member 19 of the cover mounting bracket 16 is disposed closer to the front side (cab 7 side) than the fuel filling port 8A provided at the upper part position of the engine 8. Thus, the work for supplying the lubricant oil to the fuel filling port 8A of the engine 8 is not hindered by the cover mounting bracket 16. Accordingly, workability of the fuel filing work can be improved.

Here, the cover mounting bracket 16 extends forward from the upper sides of the left and right weight parts 11 and 12 constituting the counterweight 10. The prime mover cover 28 is supported by the connecting member 19 disposed to on the front of the inspection opening 15 of the counterweight 10, rotatably through the hinge 31. Thus, a large work space is ensured on the upper side of the inspection opening 15 formed between the left and right weight parts 11 and 12. As a result, workability when the inspection work for the engine 8 and the like is performed through the inspection opening 15 can be improved.

Moreover, the prime mover cover 28 is supported by the cover mounting bracket 16 extending to the front of the counterweight 10. Thus, there is no need to provide the left and right mounting parts extending forward from the upper ends of the left and right weight parts on the counterweight 10 as in the counterweight according to the prior art. As a result, in the hydraulic excavator 1 according to this embodiment, the gravity center of the counterweight 10 is not moved to the front side. As a result, the gravity center of the counterweight 10 can be held on the rear side, and stability of the body can be ensured.

On the other hand, the cover mounting bracket 16 is provided at the position covering the boundary part 23 between the upper surface cover 9C of the exterior cover 9 and the prime mover cover 28 from below. Each of the left extending member 17, the right extending member 18, and the connecting member 19 constituting this cover mounting bracket 16 is formed by a bottomed gutter-shaped body with the upper side open. Thus, even if the rainwater or the like enters into the gap formed in the boundary part 23 between the prime mover cover 28 and the upper surface cover 9C which are at the closed position, the rainwater or the like is accommodated in the cover mounting bracket 16. On the other hand, when the prime mover cover 28 is moved from the closed position to the open position, even if the rainwater or the like falls from the prime mover cover 28, this rainwater or the like is accommodated in the cover mounting bracket 16. The rainwater or the like accommodated in the cover mounting bracket 16 can be discharged to the counterweight 10 side along the bottom plates 17C and 18C of the left and right extending members 17 and 18 which are inclined bottom surfaces.

Furthermore, the front-side seal material 21 is mounted on the upper ends of the left side plate 17D of the left extending member 17, the right side plate 18E of the right extending member 18, and the front side plate 19D of the connecting member 19 constituting the cover mounting bracket 16. The rear-side seal material 22 is mounted on the upper ends of the right side plate 17E of the left extending member 17, the left side plate 18D of the right extending member 18, and the rear side plate 19E of the connecting member 19. These front-side seal material 21 and rear-side seal material 22 are brought into contact with the inner side surface of the upper surface plate 29 when the prime mover cover 28 holds the closed position. As a result, a gap between the upper surface plate 29 and the cover mounting bracket 16 is sealed by the front-side seal material 21 and the rear-side seal material 22 in a liquid tight manner. As a result, splash-out of the rainwater, washing water or the like to the outside of the cover mounting bracket 16 during the operation of the hydraulic excavator 1 and adhering to the onboard devices such as the engine 8 and the sensors can be suppressed.

On the other hand, when the body of the hydraulic excavator 1 takes the front inclined attitude, the height positions of the front ends 17B and 18B of the left and right extending members 17 and 18 constituting the cover mounting bracket 16 become lower than the height position of the rear ends 17A and 18A. Accordingly, the rainwater or the like falling into the cover mounting bracket 16 is collected in the connecting member 19. In this case, the rainwater or the like in the connecting member 19 is discharged to the outside of the connecting member 19 through the left drainage hole 24 and the right drainage hole 25. The rainwater or the like discharged from the right drainage hole 25 flows into the drainage pipe 26, and the rainwater or the like discharged from the left drainage hole 24 flows into the drainage pipe 26 through the auxiliary drainage pipe 27. The rainwater or the like having flowed into the drainage pipe 26 is led to the drainage groove 13 of the counterweight 10 through the other end 26B of the drainage pipe 26 and is discharged to the lower end 10A of the counterweight 10 along the drainage groove 13. As a result, the rainwater or the like led to the counterweight 10 from the drainage pipe 26 can be discharged from one spot along the drainage groove 13. As a result, the range through which the rainwater or the like is discharged along the counterweight 10 can be narrowed.

Moreover, the drainage pipe 26 formed by using a metal pipe also serves as a strength member supporting the connecting member 19 of the cover mounting bracket 16 from below. As a result, mounting strength of the cover mounting bracket 16 extending to the front of the counterweight 10 can be improved. As a result, the cover mounting bracket 16 can stably support the prime mover cover 28.

Then, according to the embodiment, the cover mounting bracket 16 connecting the left weight part 11 and the right weight part 12 is provided on the upper sides of the left weight part 11 and the right weight part 12 constituting the counterweight 10. The cover mounting bracket 16 is formed as a frame by the left extending member 17 extending forward from the upper side of the left weight part 11, the right extending member 18 extending forward from the upper side of the right weight part 12, and the connecting member 19 connected to the front side of the left extending member 17 and the front side of the right extending member 18 and extending in the left and right direction. The prime mover cover 28 covering the inspection opening 15 of the counterweight 10, capable of opening or closing is mounted on the connecting member 19 of the cover mounting bracket 16 through a pivotal member.

Thus, there is no need to mount engine cover by extending a part of the counterweight forward, for example. Accordingly, movement of the gravity center of the counterweight 10 forward can be suppressed, and the gravity center can beheld on the rear side and thus, stability of the body of the hydraulic excavator 1 can be ensured. Moreover, the cover mounting bracket 16 is formed as a frame by the left and right extending members 17 and 18 extending forward from the left and right weight parts 11 and 12 and the connecting member 19 connecting the front sides of the left and right extending members 17 and 18. Accordingly, a large work space can be ensured on the upper side of the inspection opening 15 of the counterweight 10. As a result, workability when the inspection work for the engine 8 and the like is performed through the inspection opening 15 can be improved.

According to the embodiment, the cover mounting bracket 16 is formed as a frame having a U-shape with the counterweight 10 side open by the left extending member 17, the right extending member 18, and the connecting member 19. Accordingly, by mounting the left and right extending members 17 and 18 on the left and right weight parts 11 and 12 of the counterweight 10, the connecting member 19 can be disposed to the front of the inspection opening 15. As a result, a large work space can be ensured above the inspection opening 15.

According to the embodiment, the prime mover cover 28 is mounted on the connecting member 19 of the cover mounting bracket 16 through the hinge 31 and is moved between the open position where the inspection opening 15 is opened and the closed position where the inspection opening 15 is closed around the hinge 31. Accordingly, only by moving the prime mover cover 28 between the open position and the closed position around the hinge 31, the inspection opening 15 can be easily opened or closed, and workability of the inspection work for the engine 8 and the like can be improved.

According to the embodiment, the fuel filling port 8A for supplying the lubricant oil is provided at the upper part position of the engine 8, and the connecting member 19 constituting the cover mounting bracket 16 connects the left extending member 17 and the right extending member 18 at the position closer to the front side than the fuel filling port 8A of the engine 8. As a result, the work for supplying the lubricant oil to the fuel filling port 8A of the engine 8 is not hindered by the connecting member 19, and the workability of the fuel filling work can be improved.

According to the embodiment, the spring member 32 for assisting the prime mover cover 28 when the prime mover cover 28 is moved from the closed position where the inspection opening 15 is closed to the open position where the inspection opening 15 is opened and the stopper 33 for holding the prime mover cover 28 at the open position when the prime mover cover 28 is opened by assistance of the spring member 32 are provided between the cover mounting bracket 16 and the prime mover cover 28. As a result, the prime mover cover 28 can be easily moved from the closed position to the open position, and the inspection opening 15 of the counterweight 10 can be rapidly opened. Moreover, the prime mover cover 28 can be held at the open position by the stopper 33.

According to the embodiment, each of the left extending member 17, the right extending member 18, and the connecting member 19 of the cover mounting bracket 16 is formed by a bottomed gutter-shaped body with the upper side open. As a result, rainwater, washing water and the like can be accommodated in the cover mounting bracket 16.

According to the embodiment, the exterior cover 9 covering the onboard devices including the engine 8 together with the prime mover cover 28 is provided on the body, and the cover mounting bracket 16 is provided at the position covering the boundary part 23 between the upper surface cover 9C of the exterior cover 9 and the prime mover cover 28 from below. As a result, the rainwater having entered the gap formed in the boundary part 23 between the upper surface cover 9C and the prime mover cover 28 and the rainwater or the like falling from the prime mover cover 28 when the prime mover cover 28 is moved from the closed position to the open position can be accommodated in the cover mounting bracket 16.

According to the embodiment, the left extending member 17 and the right extending member 18 of the cover mounting bracket 16 have the bottom plates (inclined bottom surfaces) 17C and 18C having descending gradient with the connecting member 19 sides high and the counterweight 10 sides low. As a result, the rainwater or the like accommodated in the cover mounting bracket 16 can be discharged to the counterweight 10 side along the bottom plates 17C and 18C of the left and right extending members 17 and 18.

According to the embodiment, the left and right drainage holes 24 and 25 for draining water collected in the cover mounting bracket 16 are provided in the connecting member 19 of the cover mounting bracket 16. As a result, even if the rainwater or the like is collected in the connecting member 19 of the cover mounting bracket 16 when the body takes the front inclined posture, the rainwater or the like in the connecting member 19 can be discharged to the outside of the connecting member 19 through the left drainage hole 24 and the right drainage hole 25.

According to the embodiment, the hollow drainage pipe 26 is provided between the right drainage hole 25 of the connecting member 19 in the cover mounting bracket 16 and the counterweight 10. As a result, the rainwater or the like in the connecting member 19 can be discharged to the counterweight 10 side through the drainage pipe 26 from the right drainage hole 25.

According to the embodiment, the drainage pipe 26 has its one end 26A connected to the right drainage hole 25 of the cover mounting bracket 16 and the other end 26B connected to the inner side surface 12E faced with the engine 8 in the counterweight 10. On the other hand, the drainage groove 13 cut away downward from the portion to which the other end 26B of the drainage pipe 26 is connected is provided in the inner side surface 12E of the counterweight 10. As a result, the rainwater or the like led to the inner side surface 12E of the counterweight 10 from the drainage pipe 26 can be discharged to the lower end 10A of the counterweight 10 along the drainage groove 13.

According to the embodiment, the drainage pipe 26 also serves as the strength member supporting the connecting member 19 of the cover mounting bracket 16 from below. As re result, strength of the cover mounting bracket 16 extending to the front of the counterweight 10 can be improved, and the prime mover cover 28 can be stably supported by the cover mounting bracket 16.

It should be noted that in the embodiment, the case where the two drainage holes, that is, the left drainage hole 24 and the right drainage hole 25 are provided in the connecting member 19 of the cover mounting bracket 16 is exemplified. However, the present invention is not limited to that and it may be so constituted that one or three or more drainage holes are provided, for example.

Moreover, in the embodiment, the case where one end 27A of the auxiliary drainage pipe 27 is connected to the left drainage hole 24 provided in the connecting member 19, and the other end 27B of the auxiliary drainage pipe 27 is connected to the middle portion of the drainage pipe 26 is exemplified. However, the present invention is not limited to that and may be so constituted that another drainage pipe formed similarly to the drainage pipe 26 is prepared, and this another drainage pipe is provided between the left drainage hole 24 of the connecting member 19 and the counterweight 10, for example.

Furthermore, in the embodiment, the case applied to the crawler-type hydraulic excavator 1 is exemplified, but the present invention is not limited to that and can be also applied to other construction machines such as a wheel-type hydraulic excavator and the like.

DESCRIPTION OF REFERENCE NUMERALS

1: Hydraulic excavator (Construction machine)
2: Lower traveling structure (Body)
3: Upper revolving structure (Body)
4: Front device
5: Revolving frame (Body frame)
8: Engine (Prime mover)
8A: Fuel filling port
9: Exterior cover
9A: Left side surface cover
9B: Right side surface cover
9C: Upper surface cover
10: Counterweight
11: Left weight part
12: Right weight part
12E: Inner side surface
13: Drainage groove
14: Lower weight part
15: Inspection opening
16: Cover mounting bracket
17: Left extending member
17C, 18C: Bottom plate (Inclined bottom surface)
18: Right extending member
19: Connecting member
23: Boundary part
24: Left drainage hole (Drainage hole)
25: Right drainage hole (Drainage hole)
26: Drainage pipe (Pipe body)
28: Prime mover cover
31: Hinge (Pivotal member)
32: Spring member
33: Stopper

The invention claimed is:

1. A construction machine comprising:

a body frame constituting an automotive body; and a from device provided on a front side of the body frame;

the body frame including;

a counterweight provided on a rear side of the body frame in order to take a weight balance with the from, device; and a prime mover mounted on a front side of the counterweight; and the counterweight including;

a left weight part located on a left side in a left and right direction and rising upward from the body frame;

a right weight part located on a right side in the left and right direction and rising upward from the body frame;

a lower weight part connecting lower sides of the left weight part and the right weight part; and an inspection opening for inspecting the prime mover surrounded by the left weight part, the right weight pan, and the lower weight part, wherein a cover mounting bracket connecting the left weight part and the right weight part is provided on an upper side of the left weight part and the right weight part constituting the counterweight;

the cover mounting bracket is formed as a frame by a left extending member extending forward from an upper side of the left weight part a right extending member extending forward from the upper side of the right weight part, and a connecting member connected to a front side of the left extending member and the front side of the right extending member and extending in the left and right direction;

a prime mover cover covering the inspection opening of the counterweight capable of opening or closing is mounted on the connecting member of the cover mounting bracket through a pivotal member;

a fuel filling port for supplying a lubricant oil is provided at an upper part position of the prime mover; and the connecting member constituting the cover mounting bracket connects the left extending member and the right extending member at a position closer to a front side than the fuel filling port of the prime mover.

2. A construction machine comprising:

a body frame constituting an automotive body; and a front device provided on a front side of the body frame;

the body frame including:

a counterweight provided on a rear side of the body frame in order to take a weight balance with the front device; and a prime mover mounted on a front side of the counterweight; and the counterweight including:

a left weight part located on a left side in a left and right direction and rising upward from the body frame;

a right weight part located on a right side in the left and right direction and rising upward from the body frame;

a lower weight part connecting lower sides of the left weight part and the right weight part; and an inspection opening for inspecting the prime mover surrounded by the left weight part, the right weight part, and the lower weight part, wherein a cover mounting bracket connecting the left weight part and the right weight part is provided on an upper side of the left weight part and the right weight part constituting the counterweight;

the cover mounting bracket is formed as a frame by a left extending member extending forward from an upper side of the left weight part, a right extending member extending forward from the upper side of the right weight part, and a connecting member connected to a front side of the left extending member and the front side of the right extending member and extending in the left and right direction;

a prime mover cover covering the inspection opening of the counterweight capable of opening or closing is mounted on the connecting member of the cover mounting bracket through a pivotal member; and a spring member assisting the prime mover cover when the prime mover cover is moved from a closed position where the inspection opening is closed to an open position where the inspection opening is opened and a stopper for holding the prime mover cover at the open position when the prime mover cover is opened by assistance of the spring member are provided between the cover mounting bracket and the prime mover cover.

3. A construction machine comprising:

a body frame constituting an automotive body; and a front device provided on a front side of the body frame;

the body frame including:

a counterweight provided on a rear side of the body frame in order to take a weight balance with the front device; and a prime mover mounted on a front side of the counterweight; and the counterweight including:

a left weight part located on a left side in a left and right direction and rising upward from the body frame;

a right weight part located on a right side in the left and right direction and rising upward from the body frame;

a lower weight part connecting lower sides of the left weight part and the right weight part; and an inspection opening for inspecting the prime mover surrounded by the left weight part, the right weight part, and the lower weight part, wherein a cover mounting bracket connecting the left weight part and the right weight part is provided on an upper side of the left weight part and the right weight part constituting the counterweight;

the cover mounting bracket is formed as a frame by a left extending member extending forward from an upper side of the left weight part, a right extending member extending forward from the upper side of the right weight part, and a connecting member connected to a front side of the left extending member and the front side of the right extending member and extending in the left and right direction;

a prime mover cover covering the inspection opening of the counterweight capable of opening or closing is mounted on the connecting member of the cover mounting bracket through a pivotal member;

an exterior cover covering onboard devices including the prime mover together with the prime mover cover is provided on the body;

the exterior cover is configured to include a left side surface cover covering the onboard devices from a left side, a right side surface cover covering the onboard devices from a right side, and an upper surface cover disposed so as to surround the prime mover cover and covering the onboard devices from above; and the cover mounting bracket is provided at a position covering a boundary part between the prime mover cover and the upper surface cover from below.

4. The construction machine according to claim 3, wherein each of the left extending member, the right extending member, and the connecting member of the cover mounting bracket is formed by a bottomed gutter-shaped body with an upper side open.

5. The construction machine according to claim 4, wherein a drainage hole for draining water collected in the cover mounting bracker is provided in the connecting member of the cover mounting bracket; and a hollow pipe body is provided between the drainage hole in the connecting member of the cover mounting bracket and the counterweight and the water collected in the connecting member is discharged to an outside through the pipe body from the drainage hole.

6. The construction machine according to claim 5, wherein the pipe body has one end connected to the drainage hole of the cover mounting bracket and the other end connected to an inner side surface faced with the prime mover in the counterweight;

a drainage groove cut away downward from a portion to which the other end of the pipe body is connected is provided in the inner side surface of the counterweight; and water having flowed into the pipe body is led to a lower side of the counterweight through the drainage groove.

* * * * *